US009314917B2

(12) United States Patent
Adelman

(10) Patent No.: US 9,314,917 B2
(45) Date of Patent: Apr. 19, 2016

(54) CYLINDER SAFETY SYSTEM

(71) Applicant: Air Liquide Advanced Technologies U.S. LLC, Houston, TX (US)

(72) Inventor: Ryan B. Adelman, Wilmington, DE (US)

(73) Assignee: Air Liquide Advanced Technologies U.S. LLC, Houston, TX (US)

( * ) Notice: Subject to any disclaimer, the term of this patent is extended or adjusted under 35 U.S.C. 154(b) by 132 days.

(21) Appl. No.: 14/043,986

(22) Filed: Oct. 2, 2013

(65) Prior Publication Data

US 2015/0089769 A1 Apr. 2, 2015

(51) Int. Cl.

| | |
|---|---|
| ***A45F 5/00*** | (2006.01) |
| ***B25G 1/06*** | (2006.01) |
| ***B25G 3/10*** | (2006.01) |
| ***B25G 1/08*** | (2006.01) |
| ***F17C 13/08*** | (2006.01) |

(52) U.S. Cl.

CPC .. *B25G 1/06* (2013.01); *B25G 1/08* (2013.01); *B25G 3/10* (2013.01); *F17C 13/085* (2013.01); *Y10T 16/444* (2015.01)

(58) Field of Classification Search

CPC . A45F 5/10; A45F 5/1046; A45F 2005/1073; A45F 5/102; A45F 2005/1013; A45F 3/14; B25G 1/06; B25G 1/08; B25G 3/10; F16M 13/06; A45C 13/26; B65D 23/104; B65D 23/106; B65D 63/18; A47J 45/077; Y10T 16/444; F17C 13/085

USPC ..... 294/141, 142, 27.1, 31.2, 149, 153, 294/157, 167, 169; 215/390, 396, 395

See application file for complete search history.

(56) References Cited

U.S. PATENT DOCUMENTS

| | | | | | |
|---|---|---|---|---|---|
| 1,965,726 | A | * | 7/1934 | Smith, Jr. | 294/169 |
| 2,844,346 | A | * | 7/1958 | Six | 248/141 |
| 4,109,692 | A | * | 8/1978 | Brown | 220/9.1 |
| 4,336,899 | A | * | 6/1982 | Price, II | 224/609 |
| 4,438,764 | A | * | 3/1984 | Eppolito | 128/205.22 |
| 4,486,044 | A | * | 12/1984 | Gordon et al. | 294/31.2 |
| D280,953 | S | * | 10/1985 | Paul | D3/316 |
| D281,832 | S | * | 12/1985 | Trull | D3/316 |
| 4,556,245 | A | * | 12/1985 | Gruenwald | 294/31.2 |
| 4,739,913 | A | * | 4/1988 | Moore | 224/643 |
| 4,874,109 | A | * | 10/1989 | Cook | 220/758 |
| 4,979,659 | A | * | 12/1990 | Boyd | 224/603 |
| 5,259,372 | A | * | 11/1993 | Gross et al. | 128/200.24 |
| 5,413,231 | A | * | 5/1995 | Carroll et al. | 215/396 |
| 5,680,958 | A | * | 10/1997 | Mann et al. | 220/739 |
| 7,370,660 | B2 | * | 5/2008 | Hamilton et al. | 135/67 |
| 7,976,088 | B1 | * | 7/2011 | Diciolla | 294/154 |
| 2009/0014454 | A1 | * | 1/2009 | Nelson | 220/758 |
| 2009/0065469 | A1 | * | 3/2009 | McClellan et al. | 215/390 |

* cited by examiner

*Primary Examiner* — Gabriela Puig
(74) *Attorney, Agent, or Firm* — Elwood L. Haynes

(57) ABSTRACT

A cylinder caddy, adapted to a bottle with a neck, a bottom, and a center of gravity is provided. The caddy includes a handle with a first end pivotally attached to the upper strap, and a second end configured to detachably connect to the neck. In a first position, the handle is pivoted to allow the second end to be attached to the neck, thereby requiring the removal of a regulator, allowing the storage compartment to hold a regulator, protecting the neck from dust and other particulates and allowing a user to safely carry the cylinder. In a second position, the handle is pivoted to allow the second end form a strut, thereby providing the user a more stable operating position.

10 Claims, 5 Drawing Sheets

CYLINDER SAFETY SYSTEM

BACKGROUND

Portable cylinders are commonly used to supply a variety of pure and mixed gas standards for use in industrial, medical, commercial, or residential applications. The portable cylinders may contain reactive, non-reactive, as well as flammable gas mixtures in pure form or mixed concentrations. These cylinders are used in many applications including but not limited to welding and cutting, the calibration of medical devices, as well as fixed and portable confined space and breath alcohol testing monitors.

Most portable cylinders have a relatively high ratio of length (or height) to diameter. They usually have a flat bottom and a rounded top. As these cylinders typically have service pressures of 155 psi to over 2200 psi, they are constructed with very thick walls. They are often made of steel or aluminum. These cylinders tend to be unstable whether they are standing vertically or lying horizontally. When standing vertically, especially if they have a relatively heavy regulator attached, they are prone to tipping over. When lying horizontally, they tend to roll, especially during transport.

The consequences of a pressurized cylinder accidentally discharging its contents due to tipping over or rolling can be disastrous. The accidental release of the potential energy within the cylinder can cause immediate danger to both life and property. Although the cylinders may look small, the contents can be under significant pressure, and when released uncontrollably they can displace air, creating an asphyxiation hazard. In some cases the cylinders may contain flammable or even poisonous gas.

Hence, a need exists in the industry, for a simple, safe, and effective means to transport and provide a stable working platform for portable, high pressure cylinders.

SUMMARY

A cylinder caddy, adapted to a bottle with a neck, a bottom, and a center of gravity is provided. The caddy may have a strap configured to affix circumferentially to the cylinder at a location that may be higher than the center of gravity, a bottom cup configured to affix circumferentially to the cylinder along the bottom, at least one axial strap configured to connect the strap and the bottom cup, and a storage compartment. The storage compartment may be attached to the at least one axial strap. The caddy includes a handle with a first end pivotally attached to the upper strap, and a second end configured to detachably connect to the neck or a valve attached to the neck. In a first position, the handle is pivoted to allow the second end to be attached to the neck, thereby requiring the removal of a regulator, allowing the storage compartment to hold a regulator, protecting the neck, and allowing a user to safely carry the cylinder. In a second position, the handle may be pivoted to allow the second end to form a strut or brace, thereby providing the user a more stable operating position.

DESCRIPTION OF PREFERRED EMBODIMENTS

Figure 1:
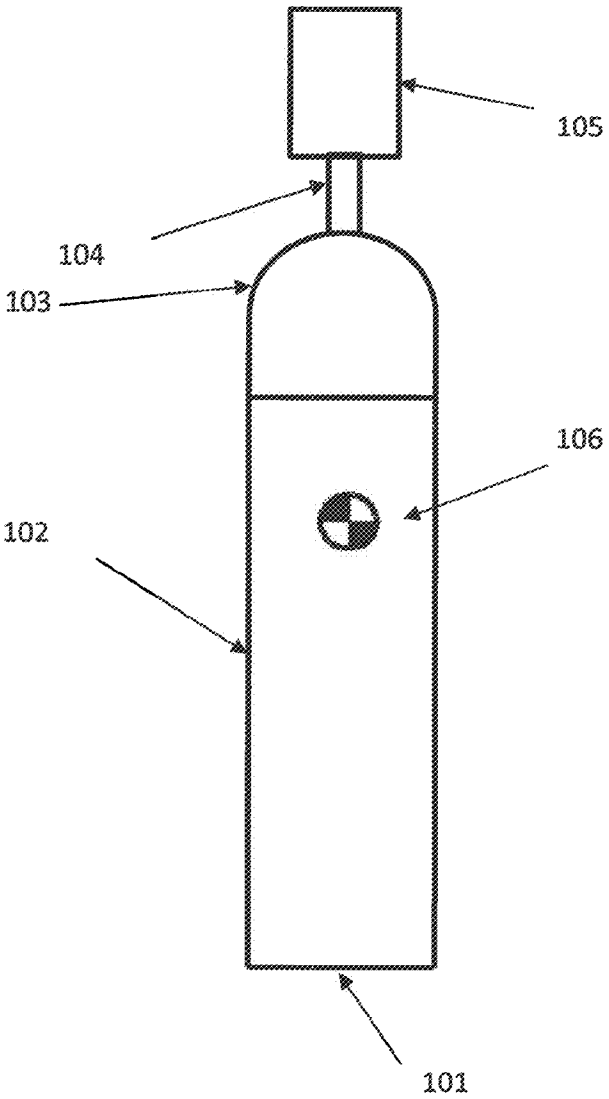
FIG. 1 illustrates a typical portable cylinder, in accordance with existing art.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As illustrated in FIG. 1, a typical portable cylinder will have a bottom 101, sides 102, a rounded top 103, and a neck 104. A flow or pressure regulator 105 will be attached to neck 104 during normal operation. Regardless of the material of construction, but especially if the cylinder is made of aluminum, the center of gravity 106 will be relatively high in the cylinder when regulator 105 is attached. This will tend to make the cylinder assembly top heavy and prone to tipping during use.

Therefore, during the usage of the cylinder assembly, safety and stability are concerns. If the cylinder is simply laid on its side, rolling instability is now a potential problem. There is also a concern about contamination, should the cylinder assembly simply be laid down on its side. The regulator and any attached hoses might inadvertently come into contact with surfaces that could taint the gas. So, laying the cylinder on the side is not an ideal solution due to this inherent instability.

Figure 2:
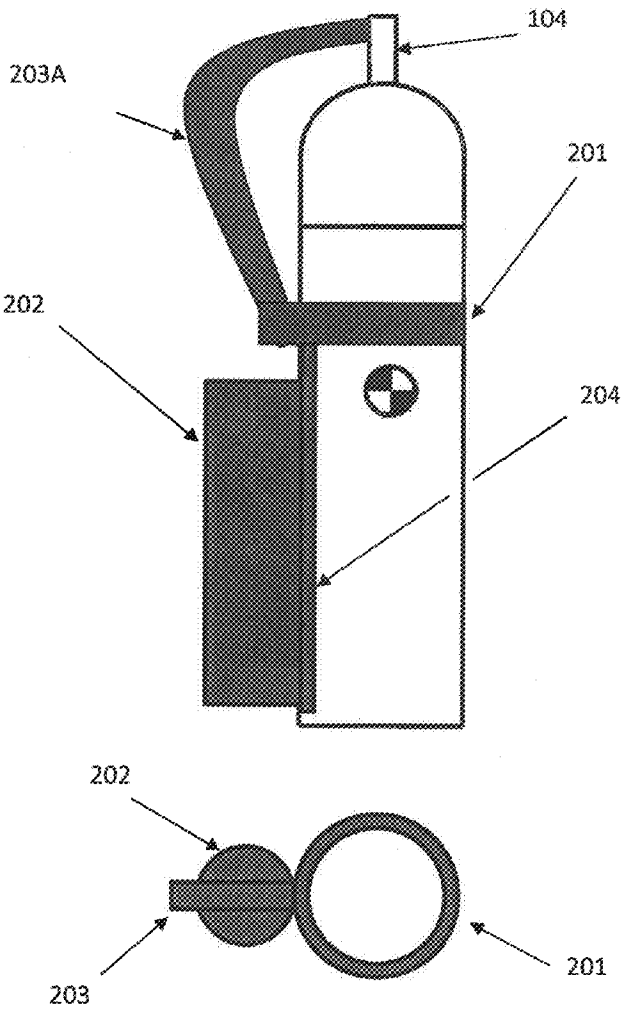
FIG. 2 illustrates one embodiment of the present invention.
Figure 2:
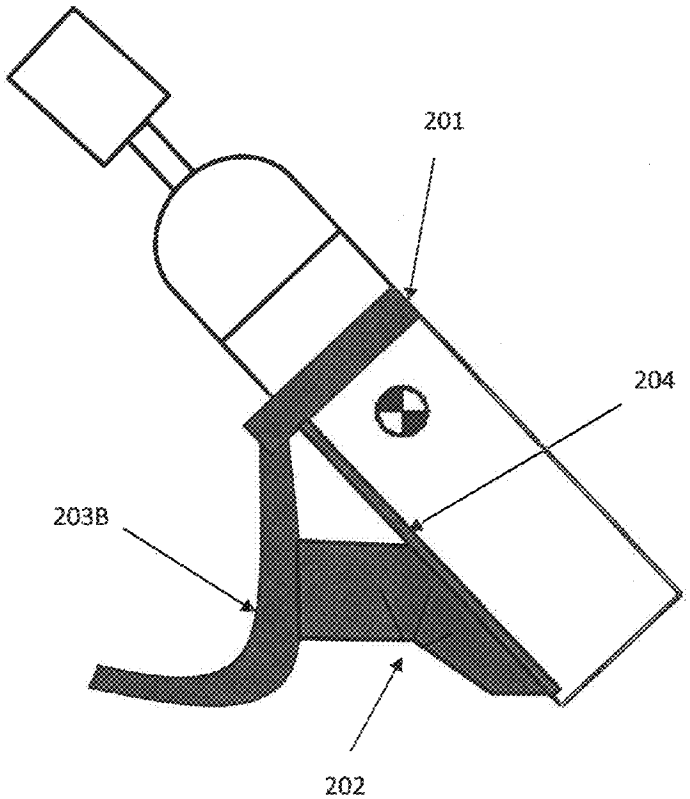

Turning to FIG. 2, a cylinder caddy is provided. The caddy includes a strap 201 that may be configured to affix circumferentially to the cylinder at a location which may be higher than the center of gravity 106 (shown). Strap 201 may be located at a position that is approximately equal to the center of gravity 106 (not shown). Strap 201 may be located at a position that is lower than the center of gravity 106 (not shown). In one embodiment, strap 201 is adjustable, and may have a buckle, hook and loop, clip, or any other means known in the art to secure it to the cylinder. In another embodiment, strap 201 may be made of an elastic polymer. Storage compartment 202 may be attached to strap 201. At least one axial strap 204 may be attached to strap 201 and also attached to storage compartment 202.

As some flow regulators 105 may include rechargeable batteries, a charging connector (not shown) may be included in storage compartment 202 which may, for example, connect to an automotive 12 volt charging port. One non-limiting example for such a usage would be for law enforcement officers using the caddy for road side breath alcohol screenings.

A handle 203 is pivotally attached to strap 201. In a first position, handle 203A is pivoted to allow the second end to attach to the neck or valve 104 of the cylinder. In this first position, it will be required that the regulator 105 be removed from the cylinder, thereby encouraging the industry recognized best practice of removing the flow regulator 105 when the cylinder is not in use, or in transit. If flow regulator 105 is left attached to the cylinder when not in use, the regulator may be damaged, or the entire contents of the cylinder my vent if there is a regulator leak. During the first position, storage compartment 202 is available to store regulator 105.

In a second position, handle 203B may be pivoted to allow the second end to form a brace, strut, or stand, thereby providing the user a more stable mode of operation (such as calibration). In the second position, storage compartment 202 may collapse and help support handle 203 in the strut position.

As indicated in FIG. 2, storage compartment 202 may be made of a flexible material, such as vinyl and may be designed to conveniently store a regulator as well as other spare components, such as batteries, tubing, etc.

Figure 3:
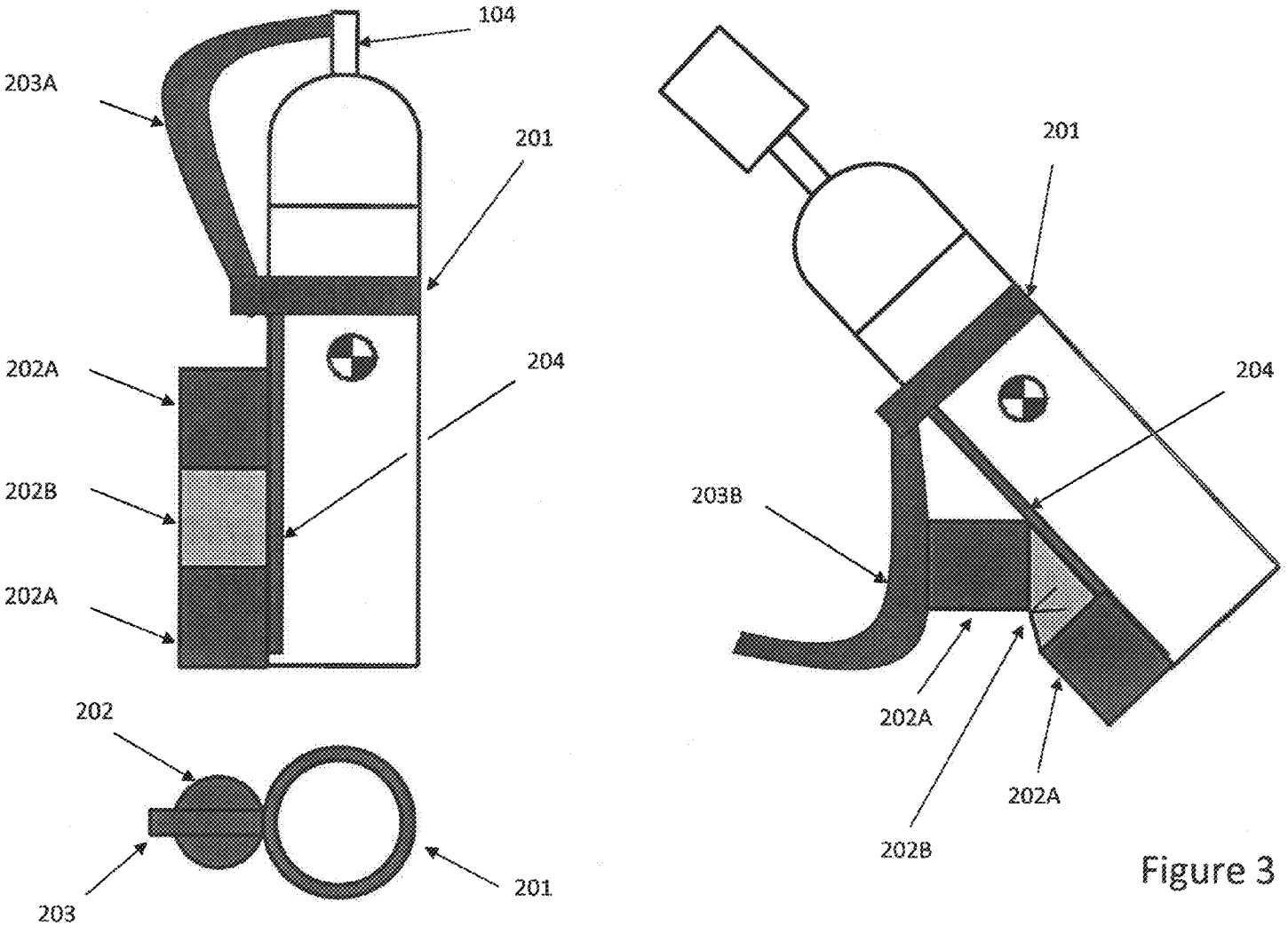
FIG. 3 illustrates another embodiment of the present invention.
Figure 4:
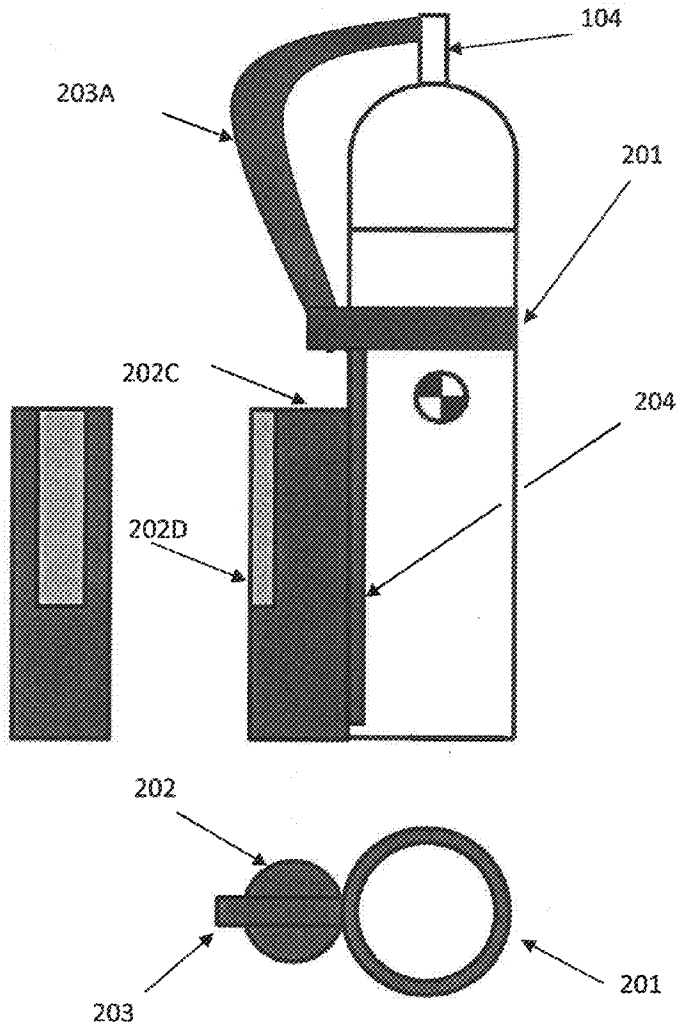
FIG. 4 illustrates another embodiment of the present invention.
Figure 4:
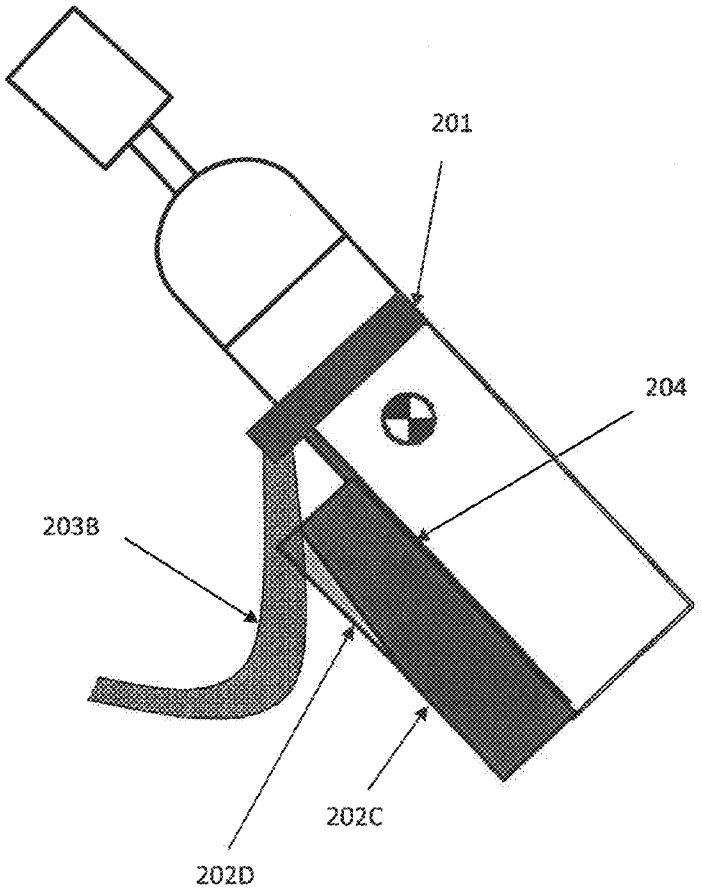

As indicated in FIGS. 3 and 4, storage compartment 202 may be made with sections of a hard material 202A or 202C, with a compressible or flexible central section 202B or 202D.

As indicated in FIG. 4, storage compartment 202 may be made of a hard material 202C, which contacts the handle 203 and connects in any manner known in the art. A portion 202D of storage compartment 202 may be made of a flexible or compressible section.

In an alternate embodiment, still indicated in FIG. 4, storage compartment 202 may be made of a flexible material 202C, which is connected to a strip of hard material 202D. The flexible material 202C collapses when the handle is in the second position, and the hard material 202D connects to handle 203 in any manner known in the art.

Figure 5:
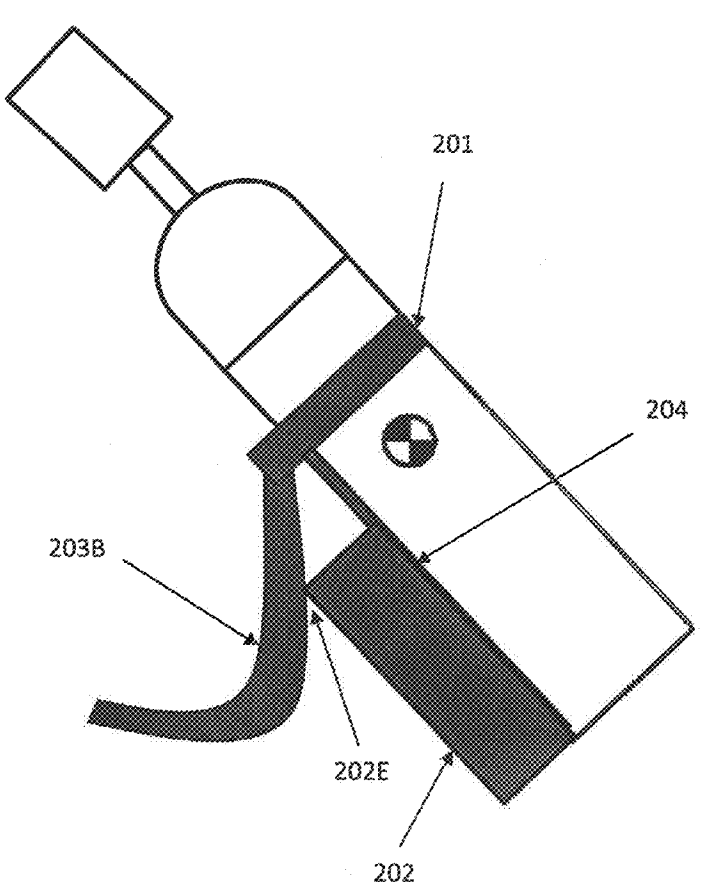
FIG. 5 illustrates another embodiment of the present invention.
Figure 5:
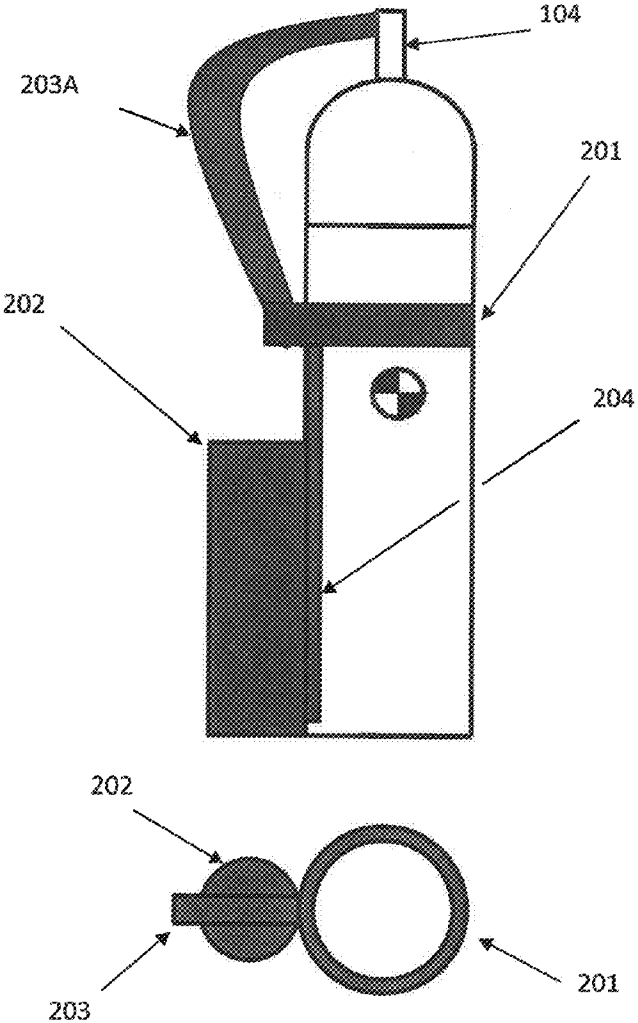

As indicated in FIG. 5, storage compartment 202 may be made of a hard material which contacts 202E the handle 203 and connects in any manner known in the art.

What is claimed is:

1. A cylinder caddy, adapted to a bottle with a neck, a bottom, and a center of gravity, comprising:

a strap configured to affix circumferentially to the cylinder, a storage compartment, wherein the storage compartment is attached to the strap, a handle with a first end pivotally attached to the strap, and a second end configured to detachably connect to the neck, wherein, in a first position, the handle is pivoted to allow the second end to be attached to the neck, thereby requiring the removal of a regulator, allowing the storage compartment to hold the regulator, protecting the neck and allowing a user to carry the cylinder, in a second position, the handle is pivoted to allow the attachment of the regulator wherein in the second position the second end of the handle forms a brace, thereby providing the user a more stable calibration position.

2. The cylinder caddy of claim 1, wherein the strap is comprised of an elastic polymer.

3. The cylinder caddy of claim 1, wherein the strap is attached to the cylinder at a location higher than the center of gravity.

4. The cylinder caddy of claim 1, wherein the strap is attached to the cylinder at a location approximate to the center of gravity.

5. The cylinder caddy of claim 1, wherein the strap is attached to the cylinder at a location lower than the center of gravity.

6. The cylinder caddy of claim 1, wherein the storage compartment comprises a flexible material.

7. The cylinder caddy of claim 6, wherein in the second position, the storage compartment attaches to the handle to form the brace.

8. The cylinder caddy of claim 1, wherein the storage compartment comprises a first end of inflexible material, a second end of inflexible material, and a central zone of flexible material.

9. The cylinder caddy of claim 1, wherein the storage compartment comprises an inflexible material.

10. The cylinder caddy of claim 1, wherein the strap is configured to adapt to cylinders of varying diameter.

* * * * *